US008826578B2

(12) United States Patent
Nogueira

(10) Patent No.: US 8,826,578 B2
(45) Date of Patent: Sep. 9, 2014

(54) FUNCTIONAL AND AUTONOMOUS METALLIC STRUCTURE FOR FIREARMS, AND RESULTING COMPOSITE, METAL-PLASTIC REVOLVER

(75) Inventor: Plinio Assis França Nogueira, Porto Alegre (BR)

(73) Assignee: Forjas Tauras S/A, Porto Alegre-RS (BR)

( * ) Notice: Subject to any disclaimer, the term of this patent is extended or adjusted under 35 U.S.C. 154(b) by 0 days.

(21) Appl. No.: 13/582,252

(22) PCT Filed: Jan. 15, 2010

(86) PCT No.: PCT/BR2010/000013

§ 371 (c)(1),
(2), (4) Date: Aug. 31, 2012

(87) PCT Pub. No.: WO2011/085456

PCT Pub. Date: Jul. 21, 2011

(65) Prior Publication Data

US 2013/0008069 A1 Jan. 10, 2013

(51) Int. Cl.
*F41C 3/14* (2006.01)

(52) U.S. Cl.
CPC ..... *F41C 3/14* (2013.01)
USPC ..... 42/59; 42/75.01; 42/71.02

(58) Field of Classification Search
USPC ..... 42/59, 65, 71.01, 71.02, 75.02, 75.03, 42/75.01
See application file for complete search history.

(56) References Cited

U.S. PATENT DOCUMENTS

| | | | | | |
|---|---|---|---|---|---|
| 1,790,320 | A | * | 1/1931 | Reising | 89/145 |
| 3,176,423 | A | * | 4/1965 | Geber | 42/65 |
| 3,367,053 | A | * | 2/1968 | Lewis | 42/59 |
| 3,387,399 | A | * | 6/1968 | McClenahan | 42/62 |
| 3,654,720 | A | * | 4/1972 | Ruger | 42/75.01 |
| 3,683,535 | A | * | 8/1972 | Lewis | 42/71.02 |
| 3,696,706 | A | * | 10/1972 | Seidel et al. | 89/196 |
| 3,810,326 | A | * | 5/1974 | Hillberg et al. | 42/59 |
| 4,048,901 | A | * | 9/1977 | Ghisoni | 89/132 |
| 4,148,149 | A | * | 4/1979 | Pachmayr et al. | 42/71.02 |
| 4,213,263 | A | * | 7/1980 | Brouthers | 42/59 |
| 4,218,839 | A | * | 8/1980 | Brouthers | 42/65 |

(Continued)

FOREIGN PATENT DOCUMENTS

| | | |
|---|---|---|
| EP | 0704668 | 4/1996 |
| RU | 2106591 | 3/1998 |

OTHER PUBLICATIONS

World Guns—Modern Firearms & Ammunition (online), <http://world.guns.ru/handguns/hg49-e.htm>, Aug. 16, 2012.

*Primary Examiner* — Bret Hayes
*Assistant Examiner* — Derrick Morgan
(74) *Attorney, Agent, or Firm* — Volpe and Koenig, P.C.

(57) ABSTRACT

A functional metallic and autonomous structure for fire-arms and revolvers is described. The revolver composed of metal/plastic, has a metallic structure, and is composed of the cylinder frame, provided with a hole having an internal thread for receiving and sustaining the revolver barrel. All the components of the discharge mechanism are embedded and/or sustained in said cylinder frame, defining the metallic structure, through which the junction of said cylinder frame, of the barrel and the components of the discharge mechanism will result in a semi-finished, fully functional revolver. The revolver also comprises at least a rear cover, a plate and a polymeric piece, intended for coating/covering at least a part of the metallic structure.

14 Claims, 5 Drawing Sheets

(56) References Cited

U.S. PATENT DOCUMENTS

| | | | | | |
|---|---|---|---|---|---|
| 4,297,801 | A | * | 11/1981 | Kahn | 42/59 |
| 4,316,339 | A | * | 2/1982 | Herriott | 42/59 |
| 4,391,057 | A | * | 7/1983 | Bornancini | 42/65 |
| 4,468,876 | A | * | 9/1984 | Ghisoni | 42/65 |
| 4,577,429 | A | * | 3/1986 | Waiser | 42/59 |
| 4,625,445 | A | * | 12/1986 | Ruger | 42/71.02 |
| 4,658,528 | A | * | 4/1987 | Ruger | 42/71.02 |
| 4,766,687 | A | * | 8/1988 | Ruger | 42/65 |
| 4,771,562 | A | * | 9/1988 | Ruger | 42/71.02 |
| 4,819,358 | A | * | 4/1989 | Eder | 42/65 |
| 4,899,478 | A | * | 2/1990 | Ghisoni | 42/65 |
| 4,918,850 | A | * | 4/1990 | Rick | 42/59 |
| 5,590,485 | A | | 1/1997 | Brandl | |
| 6,301,818 | B1 | * | 10/2001 | Hogue | 42/71.02 |
| 6,360,468 | B1 | * | 3/2002 | Constant et al. | 42/70.01 |
| 6,574,898 | B2 | * | 6/2003 | Spencer et al. | 42/71.02 |
| 6,711,819 | B2 | * | 3/2004 | Stall et al. | 29/898.14 |
| 7,523,578 | B2 | * | 4/2009 | Ghisoni | 42/59 |
| 7,694,449 | B1 | * | 4/2010 | Pontillo, II | 42/71.02 |
| 7,886,469 | B2 | * | 2/2011 | Curry | 42/67 |
| 7,975,418 | B2 | * | 7/2011 | Curry | 42/62 |
| 2007/0006508 | A1 | * | 1/2007 | Baker et al. | 42/71.02 |
| 2008/0060247 | A1 | * | 3/2008 | Thomele et al. | 42/71.02 |
| 2009/0044436 | A1 | * | 2/2009 | Zajk | 42/59 |
| 2010/0192441 | A1 | * | 8/2010 | Curry | 42/62 |
| 2011/0107640 | A1 | * | 5/2011 | Curry | 42/62 |

* cited by examiner

FUNCTIONAL AND AUTONOMOUS METALLIC STRUCTURE FOR FIREARMS, AND RESULTING COMPOSITE, METAL-PLASTIC REVOLVER

This application is a 35 U.S.C. §371 national phase application of PCT/BR2010/000013, which was filed Jan. 15, 2010 and is incorporated herein by reference as if fully set forth.

FIELD OF THE INVENTION

The present invention refers to the field of fire-arms, and more particularly refers to a compound revolver, which is made of a metallic structure, basically comprising the cylinder frame, the barrel and the shooting mechanism components, and on which are superposed finishing polymeric elements that are not linked to the functioning of said weapon.

GROUNDS OF THE ART

The revolvers are weapons known in the art and their development goes back to the 19th century. A revolver consists basically of a cylinder frame, inside of which is mounted, in a way of controlled rotation, the revolver cylinder, into which are inserted the cartridges. At the front part of said cylinder frame there is provided a barrel, which is aligned with one of the cylinder seats, and inside of which the bullet will move after being discharged. At the lower part of the cylinder frame there is placed the trigger, which will act on the hammer arranged at the front part of the cylinder frame. Moreover, beginning at the antero-lower vertex of the cylinder frame protrudes the revolver butt, which acts externally as a revolver grip element for the user, besides housing and supporting the master spring, which acts on the hammer for discharging the weapon.

Since the invention of revolvers and the weapons in general, several activating mechanisms have been developed, that is, the set of elements which link the trigger, the master spring and the hammer, including themselves, and intended for discharging the cartridge.

Moreover, with the emergence of new materials, and among them the plastics, the weapons began to incorporate them to a wider and wider extent, reaching the limit of the known GLOCK model 17 handgun of the year of 1982, almost entirely manufactured of several plastic materials. In spite of this reached limit, the current course for the development of new weapons goes back to a combination of materials in order to add the best functional/structural characteristics of each material in the most appropriate parts of the weapons for the respective use.

A recent example of such philosophy of development is described in the American patent application of Joseph J. Zajk, disclosed under number US 2009/0044436 on Feb. 19, 2009, patent application U.S. Ser. No. 12/184,706 of Aug. 1, 2008, claiming internal priority of the application 60/955,723 of Aug. 14, 2007, having the title "Light weight firing control housing for revolver". In this document is described a revolver, which comprises a metallic unit composed of the cylinder frame and the barrel, where a polymeric structure is fixed to this unit, said structure being designated the housing of the discharge mechanism, which comprises the revolver butt, the trigger-guard and the lower portion of the weapon, as well as a closed rear portion, which involves the hammer. According to the configuration of corresponding execution herein illustrated in the figures from 1 to 11, the unit of the cylinder frame/barrel [12, 14] is fixed to the housing of the discharge mechanism [20] and integrates the firing pin [60], while the other components of the discharge mechanism are sustained and/or coupled in the housing of the discharge mechanism [20]. In particular and in spite of the illustrated configuration of execution, the claims chart of the patent application U.S. Ser. No. 12/184,706 delimitates that at least one of the discharge mechanism components is supported in the said housing of the discharge mechanism [20].

In spite of the seeming innovation brought by this solution, it is not free of inconveniences. Among them we can distinguish that, due to the difference between the thermal dilatation coefficients of the sustaining structures of the discharge mechanism components, housing [20] and frame [12], relative displacements may occur under extreme temperature conditions between the discharge mechanisms, which are partially embedded in the frame [12] and partially in the housing [20]. Besides and mainly, the arrangement of some of the discharge mechanism components in the frame [12] and the others in the housing [20] will increment the complexity of assembling the weapon, thus increasing the cost and time involved with the manufacturing of the revolver.

Furthermore, the MP-412 REX revolver manufactured by Izhmash, which was exhibited for the first time at the fair called IWA-2000 in Nurenberg in Germany (see www.world-.guns.ru/handguns/hg49-e.htm), anticipates the solution described in the patent application above (U.S. Ser. No. 12/184,706). Notwithstanding the restricted information made available in this and in other sites, this revolver model presents a cylinder/barrel unit coupled to a metallic structure, which is entirely involved by a cover made of polymeric material. Said polymeric cover involves the revolver butt, the trigger-guard and almost all the metallic components of the discharge mechanism, thus appearing only the trigger and the hammer. From the details furnished it is not possible to determine how the plastic cover sustains the components of the discharge mechanism.

Anyway and in the above described solutions of the state-of-the-art, the assembly and the perfect functioning of the weapon will depend on the precise fitting between the metallic and the polymeric parts. If there is found a minimum backlash at the fitting of these both parts, the mechanism will not operate correctly and the weapon will not discharge. A minimum variation at the fitting between metal and non-metal may cause the inviabilization of the weapon.

Thus, an aim of the present invention is a revolver composed of a metallic structure combined with a polymeric structure, capable of overcoming the above described inconveniences.

Moreover, another aim of the present invention is to provide a metallic/polymeric compound revolver, where the discharge mechanism components are exclusively supported and fixed at the metallic structure, resulting in a greater flexibility, both for the manufacturing process and the esthetic conceptions of the polymeric structure of the revolver.

Synthesis

These and other purposes are satisfied by a metallic/polymeric composed revolver, which comprises a metallic structure composed of the cylinder frame, provided with a hole having an internal thread for receiving and sustaining the revolver barrel. All components of the discharge mechanism are embedded and/or sustained in said cylinder frame, defining the metallic structure, through which the junction of said cylinder frame, the barrel and the components of the discharge mechanism will result in a semi-finished, fully functional revolver. Besides, the revolver also comprises at least a rear cover, a plate and a polymeric piece intended for coating/covering at least a part of the metallic structure.

Moreover, another aim of the present invention is to provide a functional and autonomous cylinder frame for firearms, particularly for a revolver, provided with a hole having an internal thread for receiving and sustaining the revolver barrel, as well as comprising all the components of a discharge mechanism of a fire-arm, where the junction of said metallic structure with the components of the discharge mechanism will result in a semi-finished, fully functional revolver.

SHORT DESCRIPTION OF THE DRAWINGS

The present invention can be better understood at the light of the following detailed description, which is made in relation to a preferred configuration of an illustrative and not limited execution of the invention, which refers to the annexed figures, wherein.

Figure 6:
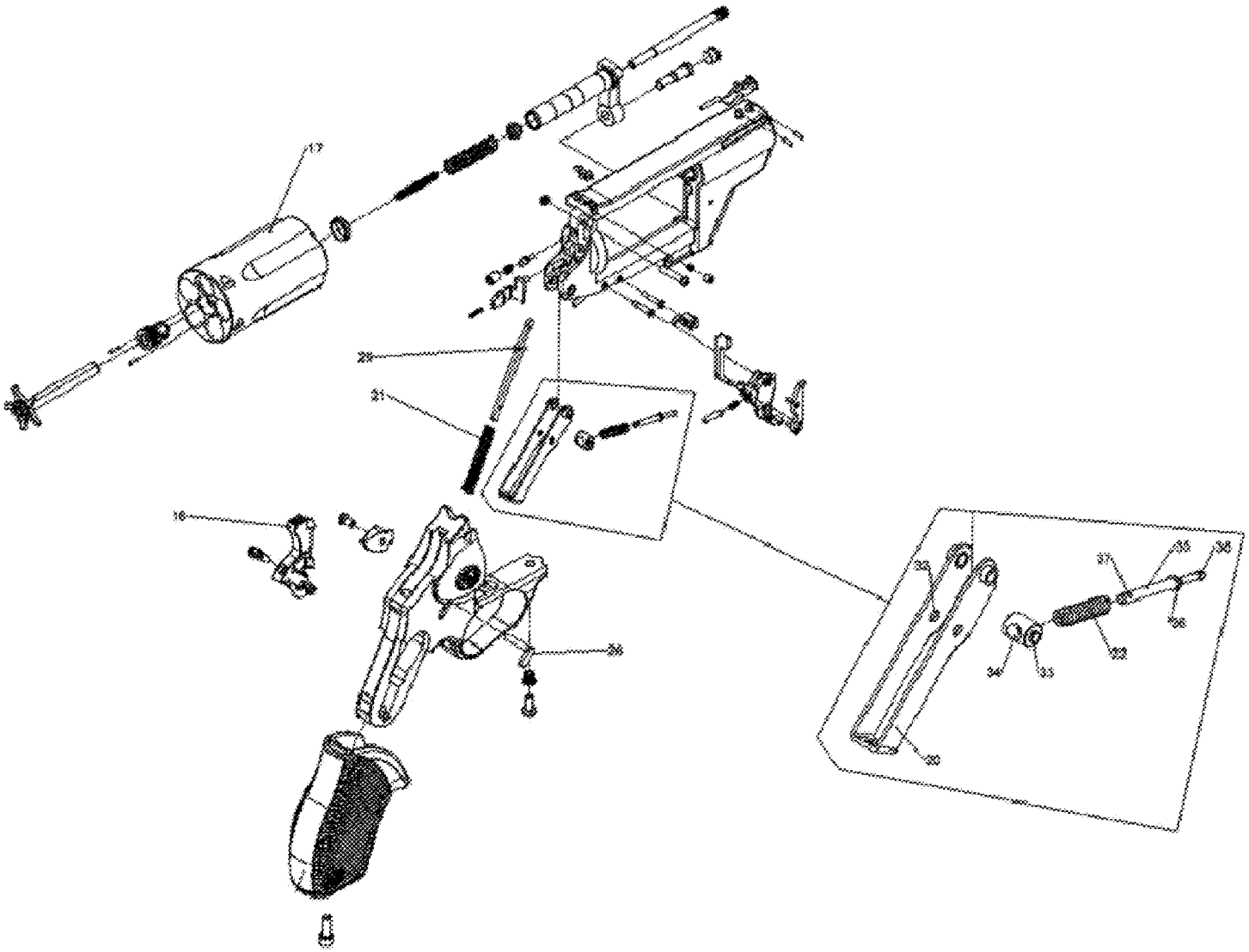
Figure 7:
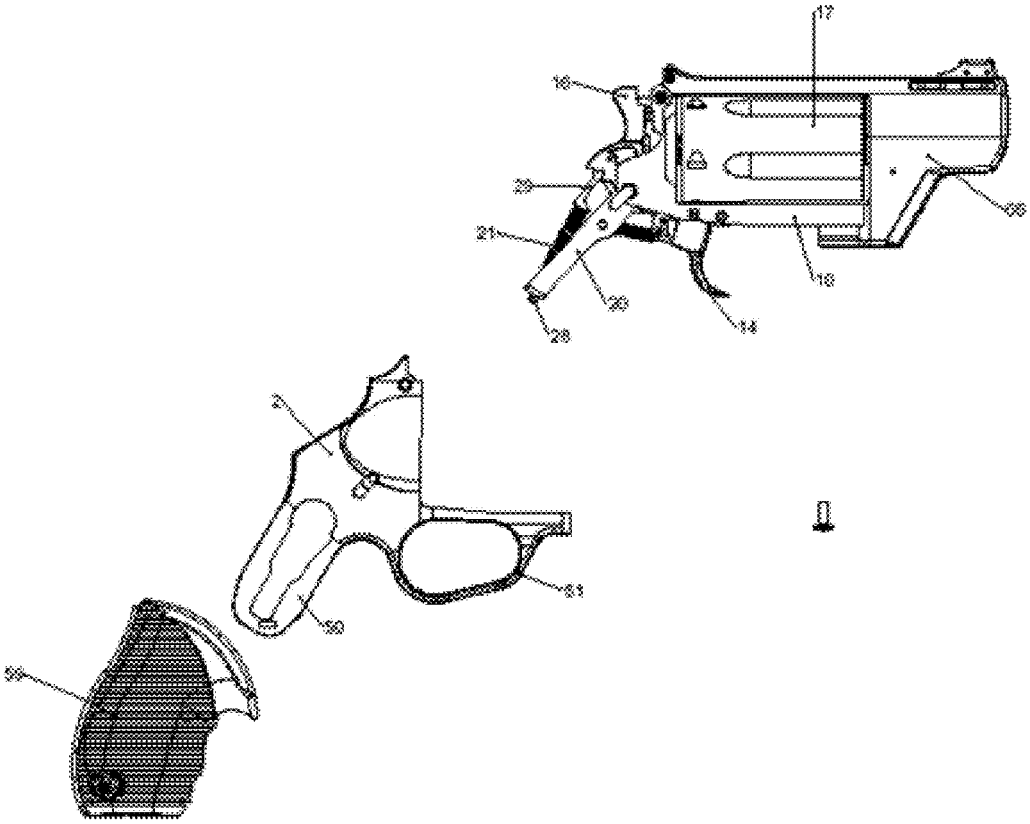
Figure 8:
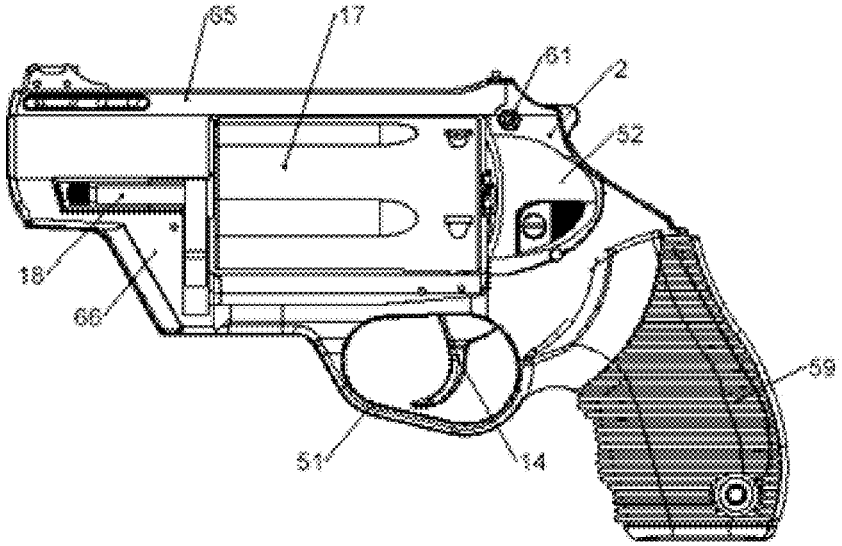
Figure 9:
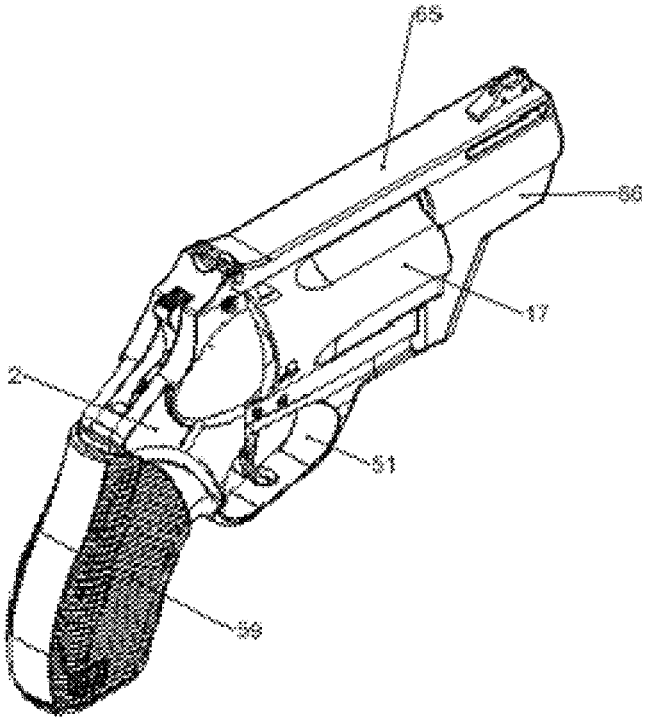

The FIGS. 6 and 7 show the revolver assembling scheme of the present invention, in an initial stage and in a phase next to the final stage respectively, where FIG. 6 also includes an enlarged detail of the trigger spring and the respective rod; and The FIGS. 8 and 9 are views in elevation and perspective respectively, illustrating the revolver in its assembled final configuration.

DESCRIPTION OF A PREFERRED CONFIGURATION OF EXECUTION OF THE INVENTION

Figure 1:
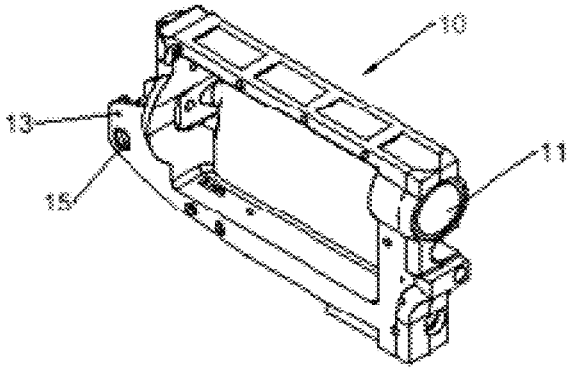
FIG. 1 shows a higher perspective view of the cylinder frame that composes the metallic structure, according to the present invention.
Figure 2:
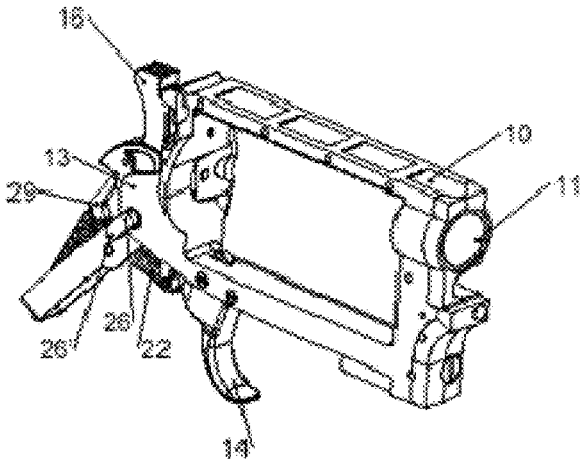
FIG. 2 is another perspective view of the cylinder frame shown in FIG. 1, however, with the components of the discharge mechanism already fixed on it.

In conformity with the annexed figures, a metallic structure is generically indicated by 1 in its totality, according to the present invention. Said metallic structure 1 comprises basically the cylinder frame 10, configured as a rigid structure with a rectangular cross section (refer specifically to FIG. 1), which provides a hole 11, having an internal thread for receiving and sustaining the barrel 12 of the revolver. Moreover, at the front portion of the cylinder frame 10 are provided two edges 13 protruding backwards in longitudinal direction, which are intended for housing and supporting part of the revolver discharge mechanism. Furthermore, and at the lower portion of the cylinder frame 10 there is provided an opening (not shown), in which is inserted and moves the trigger 14. It is to be observed that the discharge mechanism for itself is of a common type and already used in the art, and for this reason no detailed description of it will be made herein.

Figure 3:
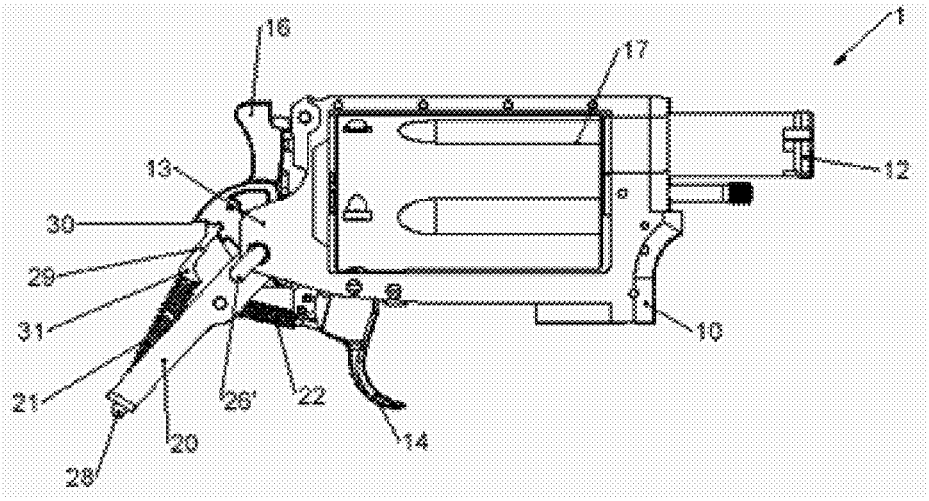
FIG. 3 shows a lateral elevated view of the metallic structure of the present invention, entirely functional and including all of the components of the discharge mechanism, the barrel and the cylinder.
Figure 4:
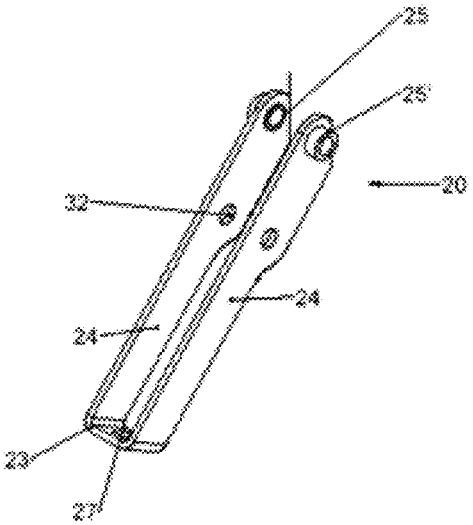
FIG. 4 is a perspective view of the spring support, according to the present invention.

The innovating aspect of the present invention lies in the arrangement of all discharge mechanism components, directly fixed to the cylinder frame 10, composing the herein called metallic structure 1 (refer specifically to FIG. 3), which is only possible through the provision of the support 20 (refer to FIG. 4), whose function is to sustain both the hammer spring 21 and the trigger spring 22 according to the description below.

In particular, the edges 13 have each one a bore 15 (refer to FIG. 1) in their respective front ends, where said bores 15 are aligned between themselves and are intended for fixing said support 20.

Said support 20 is a laminar-shaped piece having a U-shaped cross section of apexes formed by bends at 90°, thus being entirely composed of a base 23, from which protrude two laterals 24. Each one of the lateral parts 24 presents in its end opposite to the base 23 a respective bore 25, externally delimited by a cylindrical surface 25'. Each one of said cylindrical surfaces 25' is dimensioned in a way to be inserted into the above-mentioned bore 15 of the edge 13 without any clearance. Moreover, the inner side of said cylindrical surfaces 25' is passed through by the axle 26 of the hammer 16, while, in assembled condition, said hammer 16 is positioned between the ends of the support 20, which on their part are positioned between the edges 13 of the cylinder frame 10.

Furthermore, the base 23 of the support 20 has a through-going bore 27, which is crossed by the lower end 28 of the rod 29 that sustains the hammer spring 21. The end 30 of the rod 29, opposite in relation to the lower end 28, is provided with a cylindrical protuberance intended to be linked to the hammer 16 in the way that is known in the art. In addition, the rod 29 has in its intermediate portion a projection 31, whose external diameter is greater than the diameter of the hammer spring 21. Thus, and when the revolver is cocked, the hammer 16 will push the rod 29, so that the rod protrudes downwards and beyond the support 20, crossing the through-going bore 27. In this condition, the hammer spring 21 is compressed between the base 23 of the support 20 and the projection 31 of the rod 29.

Besides the function described above, the support 20 is also intended for supporting one of the ends of the trigger spring 22. Specifically in an intermediate position of each of the lateral parts 24 of the support 20, bores 32 are provided between which a socket-joint 33 (refer to FIG. 6) is coupled, in a way that the aforementioned socket-joint 33 can freely rotate around its longitudinal axle. Said socket-joint 33 is also provided with a transverse through-going bore 34, intended for receiving in its inner part a first end 37 of the rod 35 of the trigger 14.

In particular, and as it is easier to be visualized through the enlarged detail of FIG. 6, the rod 35 of the trigger 14 has the shape of a cylindrical body, which incorporates a projecting stop disc 36 and with transverse growth in relation to the longitudinal axle of said rod 35. The trigger spring 22 is arranged around the front portion of the rod 35, that is, between the stop disc 36 and the socket-joint 33. Furthermore, an end 38 of the rod 35, opposite to the first end 37, is linked to the front portion of the hammer 16 and moves forward or backward according to the movements performed by the trigger 14. When in use, and considering a force applied on the trigger by the user, it moves back pushing the rod 35 against the reaction of the spring 22, which is then compressed between the stop disc 36 and the socket-joint 33. The movement of the rod 35 will cause its end 37 to penetrate more and more into the bore 34 of the socket-joint 33, until the weapon discharges and the trigger 14 is released. At this moment, the hammer spring 22 will push the rod 35 to its advanced position, moving together the hammer 16 until its rest position.

Furthermore, and inside the cylinder frame 10 (refer to FIG. 3) there is arranged the cylinder 17, which in the known way is subject to turn around its axle 18 (FIG. 8), so as to align each one of its chambers with the barrel 12 and the firing pin (not shown), through the action of the trigger 14.

In spite of not having been made a detailed description above of the revolver functioning, in view of the fact that its functioning is widely known in the state-of-the-art, the basic aspect of the present invention lies in the fact that the metallic structure 1 as described is totally autonomous and perfectly functional. In other words, all the components of the revolver discharge mechanism are fixed and/or sustained exclusively by said metallic structure 1.

This innovating characteristic of the present invention allows a wide versatility in relation to the final finished product, since the other elements that compose the revolver may be selected from a wide scale of alternatives, thus allowing the construction of various weapon models based on an autonomous functional unit, that is, from the metallic structure 1.

This way and according to another characteristic of the present invention the other composing elements are elements made of polymeric material, which are applied externally in relation to the metallic structure 1, so as to compose the revolver as a final finished product.

Figure 5:
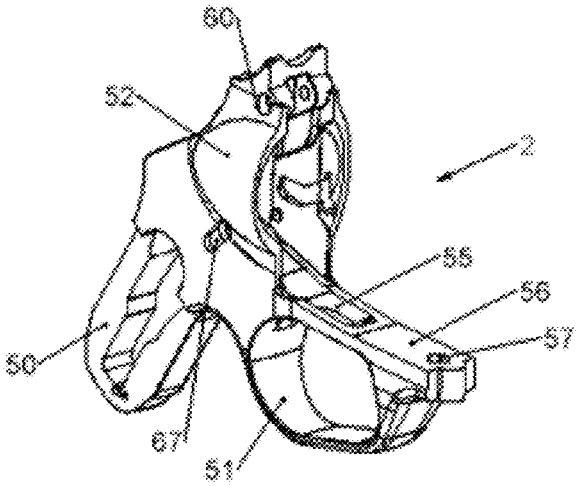
FIG. 5 is a perspective view of the rear cover, according to the present invention, which is coupled and fixed to the metallic structure shown in FIG. 3.

Thus, the FIG. 5 shows the rear cover 2, which comprises a monobloc made of polymeric material, intended for being fixed to the metallic structure 1. More particularly, the rear cover 2 is a single component, preferably injected, and includes the trigger-guard 51, the revolver butt 50 and the rear portion 52 of the revolver.

With exception made to the revolver butt 50, the parts of the rear cover 2, which define the trigger-guard 51 and the rear portion 52, compose the external surfaces of the revolver and, therefore, its finishing. This way, and as an advantage of the present invention, the rear cover 2 may have various shapes, thus resulting in weapons presenting different aspects, although the discharge mechanism is still the same. Anyway, it is indispensable that the rear portion 52 is capable of involving the edges 13 and the other components of the discharge mechanism that are arranged between said edges 13. In addition, there is provided an opening 55 so that the hammer 16 can protrude beyond the external surface of the rear cover 2, thus being directly activated by the user of the weapon. At the upper part of the rear portion 52 there are provided two holes 60, capable of receiving a respective screw/nut 61 (FIG. 8) for fixing the rear cover 2 onto the metallic structure 1.

At the lower front portion, the rear cover 2 comprises a rectangular base 56, which is intended for being in contact with the lower surface of the metallic structure 1, and particularly fixed onto it, for example, by means of a screw, which passes through the bore 57 of the base 56 and is screwed into a respective bore (not shown), provided on said lower surface of the metallic structure 1. In the illustrated configuration of execution there are three fixing points provided for the cover 2 on the metallic structure 1. Besides the two points already described, the third fixing point is provided at the rear portion 52, and particularly through the axle 26 of the hammer 16, whose cross projection 26', built in one end of the axle 26 is arranged, with the revolver in assembled condition, externally to the cover 2 and received inside a recess 67.

As mentioned above, the base 56 also comprises an opening 55, through which the trigger 14 will pass when the final assembly of the revolver is performed. At the lower part of the base 56 there is arranged the trigger-guard 51, so as to involve and protect said trigger 14 in the already known way.

At the antero-lower portion of the rear cover 2 protrudes the revolver butt 50, which has a centrally-hollowed, U-shaped solid structure. In particular, the central opening of the revolver butt 50 is configured so as to receive in its inner part the support 20 and the hammer spring 21, without having contact between the revolver butt and these components 20, 21. In other words, the revolver butt 50 simply involves the support 20 and the hammer spring 21, that is, it defines a space, into which the support 20 and the hammer spring 21 are inserted. This concept is essential within the invention scope of no functional intervention between the metallic structure 1 and the polymeric finishing components.

At the lower part of the base of the revolver butt 50 is also provided a bore (not shown), intended for fixing the grip 59 to de revolver butt 50. In this execution configuration of the invention, the grip 59 is a solid plastic piece, which fits and involves the entire revolver butt 50. Such grip is illustrated in the patent PI 9500976-0, in the name of the present depositor, herein integrally included as reference in totality. In an alternative configuration of execution, the grip (not shown) may be composed of lateral plates which are fixed/screwed directly onto the revolver butt structure, as they are provided for conventional revolvers, where those plates may also be made of polymeric material, of rubber or even of other material. In this case, it is obvious that the revolver butt 50 will assume the shape which corresponds to the final handle of the revolver.

At last, the polymeric finishing of the revolver is performed through polymeric structures arranged on its front and upper portion, what can be better visualized by the figures from 6 to 9. Thus, the upper part of the metallic structure 1 receives a plate 65 of polymeric material, which covers the whole upper portion of the metallic structure 1, as well as, and alternatively, also the upper portion of the barrel 12. In addition, a second polymeric piece 66 is provided to involve the lower part of the barrel 12, as well as the front part of the revolver, that is, the vertical and front portion of the cylinder frame 10, on which is provided the hole 11 for threading the barrel 12.

In another preferable execution configuration of the present invention, the plate 65 and the polymeric piece 66 compose a single piece, which is over-injected onto the metallic surface of the weapon. In particular, the obtainment of the metallic structure 1 as well as the forming of the polymeric coating 65/66 are described in a detailed way in the patent application of the same holder, deposited on the same date as the present patent application, under the title "process for the manufacture of fire-arm".

The aim of the present invention, as a result of its completely innovating concept, allows obtaining various benefits and advantages in relation to what is known by the state-of-the-art. Especially the assembling process of the weapon becomes easier and more agile, besides allowing that the mechanical components of the discharge system be tested before concluding the assembly of the revolver.

Thus, and from the production of the cylinder frame 10 and the fixation of the barrel 12 in its hole 11, all the components of the discharge mechanism are mounted and tested without the necessity of installing any of the polymeric elements of the final weapon. After having performed the necessary tests on the functional metallic structure 1, any of the components that may require an adjustment or rectification/qualification, can be disassembled and reworked in order to correct the irregularity identified during the preliminary tests. After conclusion of those possible repairs, the revolver is assembled again, removing only the hammer 16 and its respective axle 26. Afterwards, the polymeric cover 2 is mounted and the hammer installed again, where its axle 26 also acts as one of the fixing points of the polymeric cover 2 on the metallic structure 1.

In a preferable execution of assembling the revolver, according to the present invention, both the plate 65 and the polymeric piece 66 are over-injected onto the metallic structure 1 before the first assembling of the discharge mechanism components. Such solution turns out to be more agile with regard to the production line, in addition, it does not interfere with the assembly of said components of the weapon discharge mechanism, since they are merely finishing structures and without any binding to said discharge mechanism components.

Moreover, the solution proposed herein is quite versatile with respect to the esthetic conformation of the revolver. Since all components of the discharge mechanism are fixed to the cylinder frame 10, composing the metallic structure 1, the polymeric cover and the other polymeric elements 65/66 can be executed in a wide variety, thus allowing obtaining a series of weapons based on a same functional structure. Therefore, the length of the barrel 12 and the respective plate 65 can be changed, in order to obtain a long barrel revolver, instead of the short barrel revolver shown in the FIGS. 8 and 9. In the same way, the rear cover 2 may be changed in order to gain a different external shape, and the revolver butt 50 can be optionally enlarged so as to obtain a esthetically different revolver and with a bigger handle or one that may be more appropriate for a certain type of user.

On the other hand, and from the functional point of view, the present invention improves in relation to the weapons known by the state-of-the-art described above. Especially, this system ensures a better correlation between the discharge mechanism components and the cylinder which houses the ammunition. In other words, since all of the discharge mechanism components are fixed in the cylinder frame 10, the possibility of a relative displacement among these components is extremely improbable. Moreover, it is not necessary to fit a set of components (for example, a set fixed on a metallic part) into a complementary set of components (for example, a set of components fixed on a polymeric structure), as it is the case in the weapons known by the state-of-the-art. Such operation of fitting may be extremely complex due to the rigid limits that must be observed in relation to the mutual positioning of the components. If said fitting does not regard those established limits, the weapon may not operate. In some cases, even a displacement in a scale of tenth parts of millimeters may cause the non-functioning of the weapon.

A further advantage resulting from the present invention consists on the fact that the used polymeric elements are entirely free of metallic inserts, that is, of metallic elements inserted and/or cast inside polymeric elements. The possible need of such metallic inserts makes the production of the polymeric elements much more difficult and, above all, will cause a great loss of productivity due to the relative displacements between those elements during the manufacturing phase of the metallic element.

Configuration of Execution

1. Revolver composed of metal/plastic, comprising a metallic structure (1), which is composed of the cylinder frame (10), provided with a hole (11) having an internal thread for receiving and sustaining the revolver barrel (12), where all the components of the discharge mechanism are embedded and/or sustained in said cylinder frame (10), defining the metallic structure (1), through which the junction of said cylinder frame (10), of the barrel (12) and the components of the discharge mechanism will result in a semi-finished, fully functional revolver; and where the revolver also comprises at least a rear cover (2), a plate (65) and a polymeric piece (66), intended for coating/covering at least a part of the metallic structure (1).

2. Revolver, according to the configuration of execution 1, where the metallic structure (1) is provided, at the front portion, with two edges (13), in parallel between themselves and protruding backwards in longitudinal direction, where each of both edges (13) has a respective bore (15) and said edges (13) are intended for fixing the support (20).

3. Revolver, according to the configuration of execution 1, comprising a laminar support (20) with a U-shaped cross section, having a base (23) provided with a central bore (27), from which protrude two laterals (24) in parallel, where each one of these lateral parts presents in its end opposite to the said base (23) a respective bore (25), externally delimited by a cylindrical surface (25'), and where bores (32), aligned between themselves, are provided in an intermediate position of each lateral part (24).

4. Revolver, according to the configuration of execution 2 or 3, where each one of the cylindrical surfaces (25') is intended for being inserted into the respective bores (15) in the edges (13) of the metallic structure (1), and where the hammer (16) is arranged, in assembled condition of the revolver, between the lateral parts (24) of the support (20), and the entire unit being maintained in position in a linked manner through the hammer axle (26).

5. Revolver, according to the configuration of execution 2-4, where the bore (27) of the base (23) of the above-mentioned support (20) is passed through by the lower end of the supporting rod (29) and the hammer spring guide (21), so that the hammer spring (21) is compressed between the base (23) of the support (20) and an intermediate projection (31) of said rod (29), whose external diameter is greater than the diameter of the hammer spring 21.

6. Revolver, according to the configuration of execution 2 or 3, where a socket-joint (33) is arranged and coupled between the bores (32), so that the socket-joint (33) can freely rotate around its longitudinal axle, and where the above-mentioned socket-joint (33) is also provided with a through-going transverse bore (34), intended for receiving in its interior a first end (37) of the rod (35) of the trigger (14).

7. Revolver, according to the configuration of execution 2, 3 or 6, where the trigger spring (22) is compressed between the socket-joint s (33) and the stop disc (36) of the rod (35), whose external diameter is greater than the diameter of the trigger spring (22).

8. Revolver, according to the configuration of execution 1, comprising a metallic cover (2), superposed and fitted in the metallic structure (1), where said rear cover (2), comprises a rear portion (52), from which protrudes, at the lower side, the revolver butt (50) and at the front side, a base (56), on which is formed the trigger-guard (51).

9. Revolver, according to the configuration of execution 8, where the rear portion (52) of the rear cover (2) is a metallic structure partially hollow, which involves the edges (13) of the metallic structure (1), involving a part of the discharge mechanism components as well.

10. Revolver, according to the configuration of execution 8, where the rear cover (2) is directly fixed to the metallic structure (1).

11. Revolver, according to the configuration of execution 1, where the plate (65) and the polymeric piece (66) build a single monobloc structure, directly fixed onto the cylinder frame (10) and around the barrel (12).

12. Revolver, according to the configuration of execution 1, where the plate (65) and the polymeric piece (66) build a single monobloc structure, over-injected onto the cylinder frame (10) and around the barrel (12).

13. Metallic structure (1), functional and autonomous, composed of the cylinder frame (10), with a hole (11) having an internal thread for receiving and sustaining the revolver barrel (12), which comprises all the components of a discharge mechanism of a fire-arm, where the junction of said metallic structure (1) with the components of the discharge mechanism will result in a semi-finished, fully functional revolver.

14. Metallic structure (1), according to the configuration of execution 13, having in its front portion two edges (13) in parallel between themselves and protruding backwards in longitudinal direction, where each of both edges (13) has a respective bore (15) and said edges (13) are intended for fixing the support (20).

15. Metallic structure (1), according to the configuration of execution 14, comprising a laminar support (20) with a U-shaped cross section, having a base (23) provided with a central bore (27), from which protrude two laterals (24) in parallel, where each one of these lateral parts presents in its end opposite to said base (23) a respective bore (25), externally delimited by a cylindrical surface (25'), and where bores (32), aligned between themselves, are provided in an intermediate position of each lateral part (24).

16. Metallic structure (1), according to the configuration of execution 14 or 15, where each of the cylindrical surfaces (25') is intended for being inserted into the respective bores (15) in the edges (13) of the metallic structure (1), and where the hammer (16) is arranged, in assembled condition of the revolver, between the lateral parts (24) of the support (20), and the entire unit being maintained in position in a linked manner through the hammer axle (26).

17. Metallic structure (1), according to the configuration of execution 14 or 16, where the bore (27) in the base (23) of the above-mentioned support (20) is passed through by the lower end of the supporting rod (29) and the hammer spring guide (21), so that the hammer spring (21) is compressed between the base (23) of the support (20) and an intermediate projection (31) of said rod (29), whose external diameter is greater than the diameter of the hammer spring 21.

18. Metallic structure (1), according to the configuration of execution 14 or 15, where a socket-joint (33) is arranged and coupled between the bores (32), so that the socket-joint (33) can freely rotate around its longitudinal axle, and where the above-mentioned socket-joint (33) is also provided with a through-going transverse bore (34), intended for receiving in its interior a first end (37) of the rod (35) of the trigger (14).

19. Metallic structure (1), according to the configuration of execution 14, 15 or 18, where the trigger spring (22) is compressed between the socket-joint (33) and the stop disc (36) of the rod (35), whose external diameter is greater than the diameter of the trigger spring (22).

What is claimed is:

1. A revolver composed of metal parts and plastic parts, the revolver comprising a metallic structure, which is composed by a cylinder frame provided with a hole having an internal thread for receiving and sustaining a revolver barrel, wherein all the components of a discharge mechanism are embedded, sustained, or embedded and sustained in said cylinder frame, defining the metallic structure, through which a junction of said cylinder frame, of the barrel and components of the discharge mechanism will result in a semi-finished, fully functional revolver; and where the revolver also comprises at least a rear cover, a plate and a polymeric piece, intended for coating or covering at least a part of the metallic structure, wherein the metallic structure is provided, at a rear portion, with two edges, in parallel between themselves and protruding backwards in a longitudinal direction, where each of both edges has a respective bore and said edges are intended for fixing a support, and the revolver further comprising a laminar support with a U-shaped cross section, having a base provided with a central bore, from which protrude two lateral parts in parallel, where each one of these lateral parts presents in its end opposite to the said base a respective bore, externally delimited by a cylindrical surface, and where bores of each lateral part, aligned between themselves, are provided in an intermediate position of each lateral part, and a rear cover, superposed and fitted in the metallic structure, where said rear cover comprises a rear portion, from which protrudes, at the lower side, a revolver butt and at the front side, a base, on which is formed a trigger-guard.

2. The revolver according to claim 1, wherein each one of the cylindrical surfaces is intended for being inserted into the respective bores in the edges of the metallic structure, and where a hammer having a hammer axle is arranged, in assembled condition of the revolver, between the lateral parts of the support, and the support being maintained in position in a linked manner through the hammer axle.

3. The revolver according to claim 1, wherein the bore of the base of the above-mentioned support is passed through by the lower end of a supporting rod and a hammer spring guide of a hammer associated with a hammer spring, so that the hammer spring is compressed between the base of the support and an intermediate projection of said rod, whose external diameter is greater than the diameter of the hammer spring.

4. The revolver according to claim 1, further comprising a socket-joint arranged and coupled between the bores, so that the socket-joint can freely rotate around its longitudinal axle, and where the above-mentioned socket-joint is also provided with a through-going transverse bore, intended for receiving in its interior a first end of a rod of a trigger.

5. The revolver according to claim 1, wherein a trigger spring is compressed between the socket-joint and a stop disc of the rod, whose external diameter is greater than the diameter of the trigger spring.

6. The revolver according to claim 1, wherein the rear portion of the rear cover is a metallic structure partially hollow, which involves edges of the metallic structure, involving a part of the discharge mechanism components as well.

7. The revolver according to claim 1, wherein the rear cover is directly fixed to the metallic structure.

8. The revolver according to claim 1, wherein the plate and the polymeric piece build a single monobloc structure, directly fixed onto the cylinder frame and around the barrel.

9. The revolver according to claim 1, wherein the plate and the polymeric piece build a single monobloc structure, over-injected onto the cylinder frame and around the barrel.

10. A metallic structure, functional and autonomous, comprising a cylinder frame with a hole having an internal thread for receiving and sustaining a revolver barrel and all components of a discharge mechanism of a firearm, wherein the junction of said metallic structure with the components of the discharge mechanism will result in a semi-finished, fully functional revolver, the metallic structure further comprising two edges in parallel between themselves and protruding backwards in longitudinal direction in its front portion, and wherein each of both edges has a respective bore and said edges are intended for fixing the support, a laminar support with a U-shaped cross section, having a base provided with a central bore, from which protrude two lateral parts in parallel, where each one of these lateral parts presents in its end opposite to said base a respective bore, externally delimited by a cylindrical surface, and where bores of each lateral part, aligned between themselves, are provided in an intermediate position of each lateral part, and a rear cover, superposed and fitted in the metallic structure, where said rear cover comprises a rear portion, from which protrudes, at the lower side, a revolver butt and at the front side, a base, on which is formed a trigger-guard.

11. The metallic structure according to claim 10, wherein each of the cylindrical surfaces is intended for being inserted into the respective bores in the edges of the metallic structure, and where a hammer having a hammer axle is arranged, in assembled condition of the revolver, between the lateral parts of the support, and the support being maintained in position in a linked manner through the hammer axle.

12. The metallic structure according to claim 10, wherein the bore in the base of the above-mentioned support is passed through by the lower end of a supporting rod and a hammer spring guide of a hammer associated with a hammer spring, so that the hammer spring is compressed between the base of the support and an intermediate projection of said rod, whose external diameter is greater than the diameter of the hammer spring.

13. The metallic structure according to claim 10, further comprising a socket-joint arranged and coupled between the bores, so that the socket-joint can freely rotate around its longitudinal axle, and wherein the above-mentioned socket-joint is also provided with a through-going transverse bore, intended for receiving in its interior a first end of a rod of a trigger.

14. The metallic structure according to claim 10, wherein a trigger spring is compressed between the socket-joint and a stop disc of the rod, whose external diameter is greater than the diameter of the trigger spring.

* * * * *